US007493774B2

(12) United States Patent
Ferragut, II et al.

(10) Patent No.: US 7,493,774 B2
(45) Date of Patent: Feb. 24, 2009

(54) CONTROL SYSTEM FOR A REFRIGERATOR ICE/WATER DISPENSER

(75) Inventors: Nelson J. Ferragut, II, Williamsburg, IA (US); Brian Midlang, Cedar Rapids, IA (US); Robert L. Wetekamp, Cedar Rapids, IA (US)

(73) Assignee: Maytag Corporation, Benton Harbor, MI (US)

( * ) Notice: Subject to any disclaimer, the term of this patent is extended or adjusted under 35 U.S.C. 154(b) by 523 days.

(21) Appl. No.: 11/327,364

(22) Filed: Jan. 9, 2006

(65) Prior Publication Data

US 2007/0157641 A1 Jul. 12, 2007

(51) Int. Cl.
*B67D 5/62* (2006.01)

(52) U.S. Cl. ..... 62/177; 62/389; 222/52

(58) Field of Classification Search ..... 62/177, 62/389–390; 222/52, 146.6
See application file for complete search history.

(56) References Cited

U.S. PATENT DOCUMENTS 4,458,828 A * 7/1984 Allen et al. ..... 222/33
4,633,067 A 12/1986 Payne et al.
4,739,233 A 4/1988 Marcade
4,901,074 A 2/1990 Sinn et al.
4,966,004 A 10/1990 Midlang et al.
4,970,870 A 11/1990 Midlang et al.
4,985,194 A * 1/1991 Watanabe ..... 264/247
5,050,777 A 9/1991 Buchser
5,473,911 A 12/1995 Unger
5,526,854 A 6/1996 Unger
5,551,598 A * 9/1996 Cutsinger ..... 222/52
5,886,430 A 3/1999 Ralson et al.
6,039,219 A 3/2000 Bach et al.
6,651,449 B2 11/2003 Heims et al.
6,802,186 B2 10/2004 Holmes et al.
6,868,692 B2 3/2005 Choi
6,880,949 B2 4/2005 Miozza et al.
6,912,870 B2 7/2005 Gnadinger
2004/0188466 A1 9/2004 Choi
2004/0216471 A1 11/2004 Kim et al.
2005/0198991 A1 9/2005 Harder et al.

* cited by examiner

*Primary Examiner*—William E Tapolcai
(74) *Attorney, Agent, or Firm*—Kirk Goodwin; Michael D. Lafrenz

(57) ABSTRACT

A control system for a refrigerator ice/water dispenser includes an actuation switch, at least one drive unit for releasing either ice or water, a motor activation relay that controls operation of the drive unit, and a power system having multiple power supplies for operating the control system, motor activation relay and drive unit(s). Preferably, the dispenser includes multiple actuation switches, e.g. a water activation switch and a water/ice activation switch, each having an associated activation relay for independently controlling the release of water and/or ice respectively. Current for initiating the drive unit activation relays must pass through a corresponding actuation switch in order to prevent unintended release of water and/or ice. Multiple processor circuits are preferably employed, with one processor circuit relaying to another processor circuit to enable drive unit activation. Preferably, the actuation switches constitute membrane switches so as to maintain minimum voltage levels at the dispenser.

19 Claims, 4 Drawing Sheets

CONTROL SYSTEM FOR A REFRIGERATOR ICE/WATER DISPENSER

BACKGROUND OF THE INVENTION

1. Field of the Invention

The present invention pertains to the art of refrigerators and, more particularly, to a control system for operating a refrigerator ice/water dispenser.

2. Discussion of the Prior Art

Door mounted ice/water dispensing systems are widely known in the art of refrigerators. Depending upon a particular refrigerator model, the dispensing systems are available with a variety of options. For example, top mount and bottom mount refrigerators typically only include a water dispensing option, while side-by-side models include both water and ice dispensing options. Ice dispensing may also include options for dispensing crushed and/or cubed ice. In most instances, the dispensing system will generally include a switch that is activated by a glass or other beverage holder to initiate dispensing either water or ice.

Regardless of the particular dispensing system employed, non-intentional dispensing is highly undesirable. More specifically, it is highly undesirable for the dispensing system to begin releasing ice and or water without any user input as non-intentional dispensing of ice and/or water creates a mess for the consumer and may damage certain kitchen floor surfaces. An electrical short circuit, electronic or other component failure could potentially activate the dispensing system without activation of the switch.

In order to address this problem, manufacturers have developed various circuits that attempt to minimize the likelihood of a non-intentional dispensing event. One example of such an effort can be found in U.S. Pat. No. 4,739,233 directed to a motor control circuit for an ice dispensing system. The disclosed motor control routes current to a motor actuator through a dispensing actuation switch. While effective at reducing the risk of a non-intentional dispensing event, a ground short in any one of a number of locations in the motor control, circuit will activate a dispensing motor, causing ice to be released regardless of consumer demand. In addition, the system requires periodic cessation of power to the dispenser to check the position of the dispensing actuation switch. This requirement adds unnecessary complexity to the motor control.

Based on the above, despite the existence of dispensing control systems in the prior art, there still exists a need for a more advanced ice/water dispensing control system. More specifically, there exists a need for a dispensing control system that incorporates fail safe systems to more effectively minimize any potential non-intentional dispensing event.

SUMMARY OF THE INVENTION

The present invention is directed to a control system for a refrigerator ice/water dispensing unit. The control system includes an actuation switch, a drive unit that is selectively activated to release either ice or water, a control switch that controls operation of the motor, and a power system having multiple power supplies for operating the control system, control switch and drive unit. Preferably, the dispensing unit includes multiple actuation switches, e.g. a water activation switch and a water/ice activation switch, for independently controlling the release of water and ice respectively.

In accordance with the invention, the control system includes a first drive unit in the form of a water valve and a second drive unit or auger. The first and second drive units are coupled to corresponding first and second control switches. In addition, the control system includes an ice selection switch coupled to an ice selection control switch. A processor, having multiple inputs and multiple outputs, routes signals to appropriate ones of the first and second control switches, as well as the ice selection control switch depending upon a given consumer selection at a dispenser keypad.

In accordance with the most preferred form of the invention, activation current for the first and second control switches, as well as the ice selection control switch, passes through a switching device, and activation current for the switching device must pass through one of the water activation switch and the water/ice activation switch. Preferably, the control system includes first and second control circuits. The first control circuit operates the drive units, while the second control circuit enables operation of the first control circuit, while interfacing with the consumer.

In further accordance with the most preferred form of the invention, both the water activation switch and the water/ice activation switch are constituted by membrane switches coupled to the processor. The membrane switches are connected to a very low voltage source in the processor, the first, second and ice control switches are coupled to a low voltage source, and the first and second drive units are connected to line voltage. This arrangement not only avoids unintentional dispensing, but ensures that only trace voltage levels are present at the dispenser keypad.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
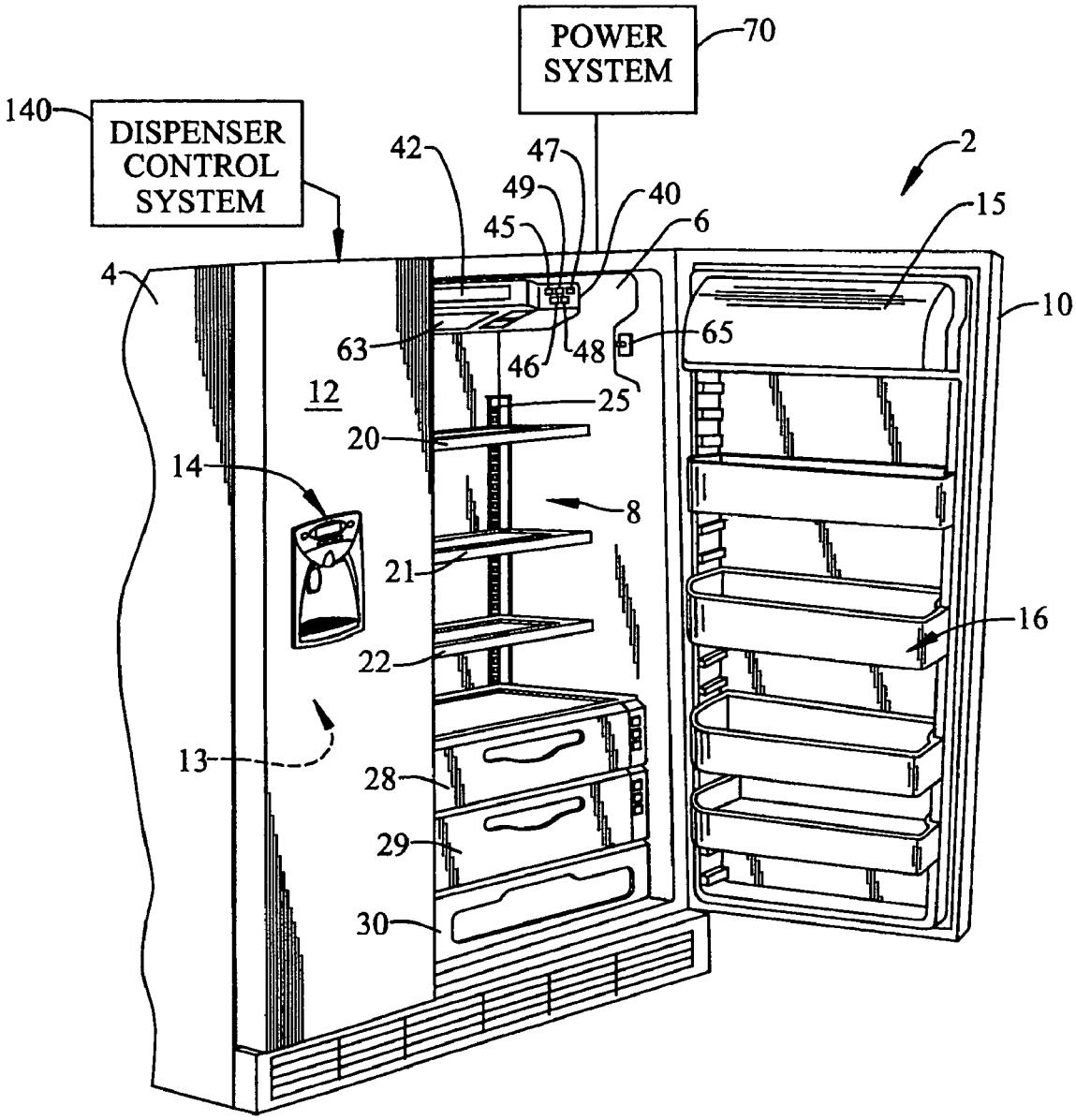
FIG. 1 is an upper left perspective view of a side-by-side refrigerator having an water/ice dispenser including a dispenser control system constructed in accordance with the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispensing unit 14 that enables a consumer to retrieve a water product, such as ice and/or fresh water, without accessing fresh food or freezer compartments 8 and 13. For the sake of completeness, fresh food door 10 is shown to include a dairy compartment 15 and various vertically adjustable shelving units, one of which is indicated at 16.

In a manner known in the art, fresh food compartment 8 is provided with a plurality of vertically adjustable shelves 20-22 supported by a pair of shelf support rails, one of which is indicated at 25. At a lowermost portion of fresh food compartment 8 is illustrated a pair of temperature controlled bins 28 and 29, as well as a conventional storage compartment 30. At an upper region of fresh food compartment 8 is a temperature control housing including a user interface 40. In the embodiment shown, interface 40 includes a display zone 42 and a plurality of control elements 45-49. Interface 40 also includes a light 63 which, in a manner known in the art, is controlled by a switch 65 operated by opening and closing fresh food door 10. Refrigerator 2 also includes a power system 70 for supplying power at various voltage levels to various components such as a compressor, fans and light 63, as well as components of dispensing unit 14 in a manner that will be detailed more fully below.

Figure 2:
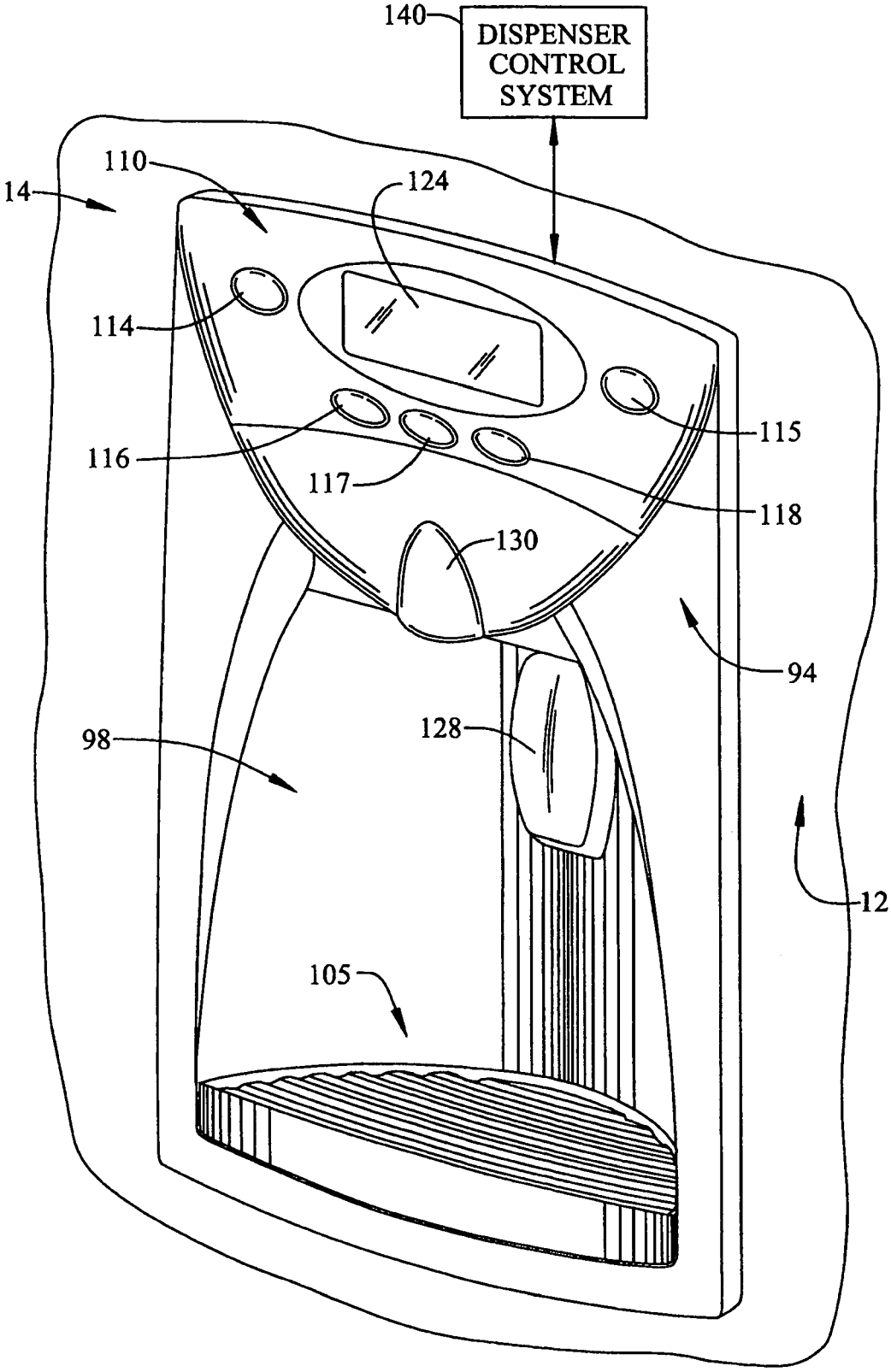
FIG. 2 is an enlarged perspective view of the water/ice dispenser and control system of FIG. 1.

As best shown in FIG. 2, dispensing unit 14 includes a facade 94 mounted to freezer door 12. Facade 94 includes a recessed portion 98 for receiving a beverage container, such as a glass, for collecting any water and/or ice released from dispensing unit 14. Dispensing unit 14 also includes a base portion 105 which is designed to catch small amounts of water and/or ice which may drip or otherwise be released from dispenser unit 14 when a container is not in recessed portion 98. Dispensing unit 14 further includes a user interface or keypad 110 having a plurality of user selection members or keys 114-118 and a display 124. Keys 114 and 115 control a dispenser light (not shown) and menu options, e.g., filter reset and dispenser lock out, respectively, while keys 116-118 enable a consumer to select between dispensing water, crushed ice or cubed ice. In addition, dispensing unit 14 is provided with actuation switches that trigger release of water and/or ice. In the embodiment shown, dispensing unit 14 includes a first or water/ice activation switch 128 positioned within recessed portion 98 that is designed to be acted upon by a beverage container, as well as a sport water activation switch 130 for releasing water either independent from or in conjunction with ice activation switch 128. In any event, the above described structure is provided for the sake of completeness and to enable a better understanding of the figures. Instead, the present invention is particularly directed to a control system 140 for dispensing unit 14.

Figure 3:
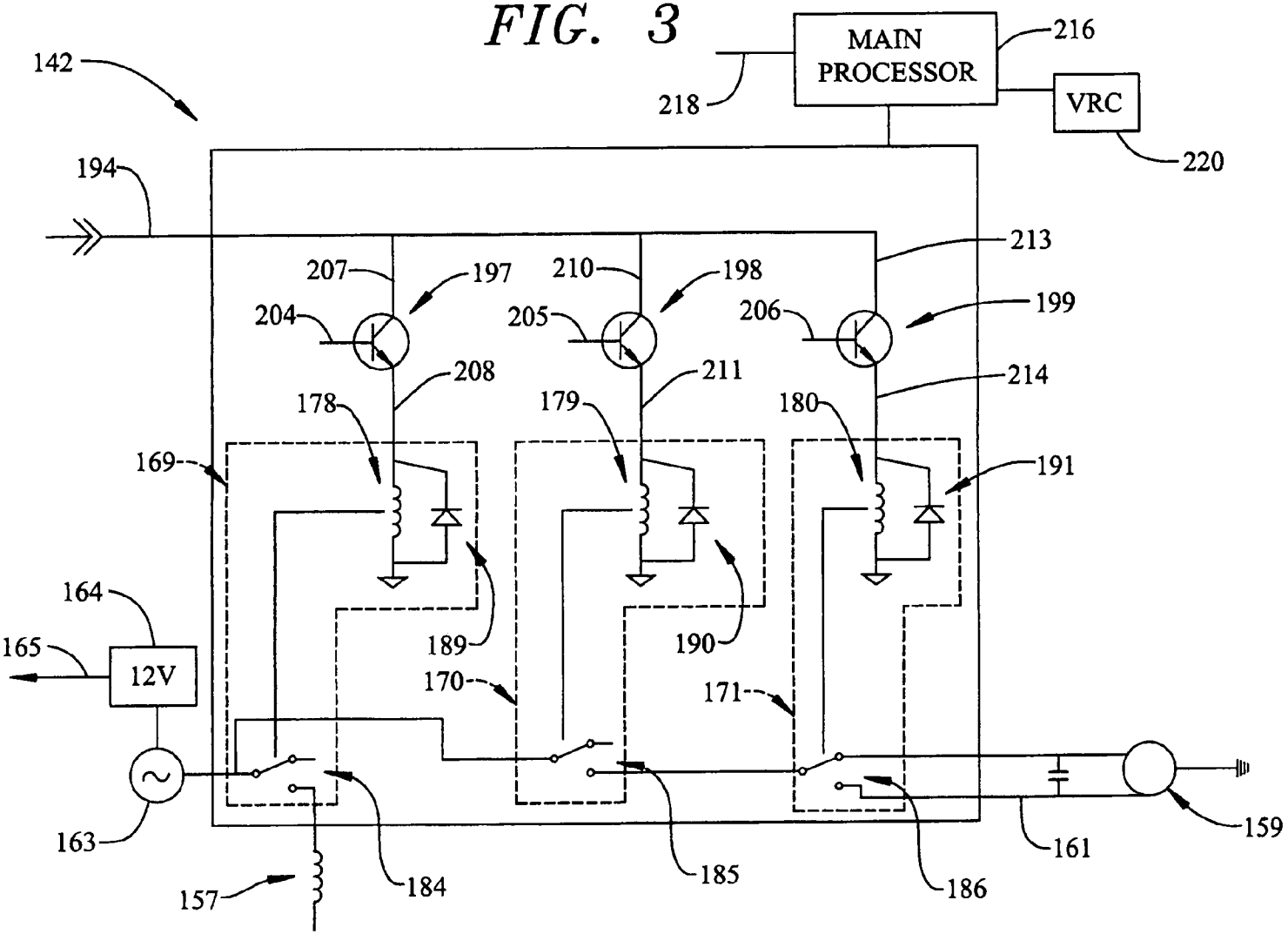
FIG. 3 is a schematic view of a first portion of the dispenser control system constructed in accordance with the present invention.
Figure 4:
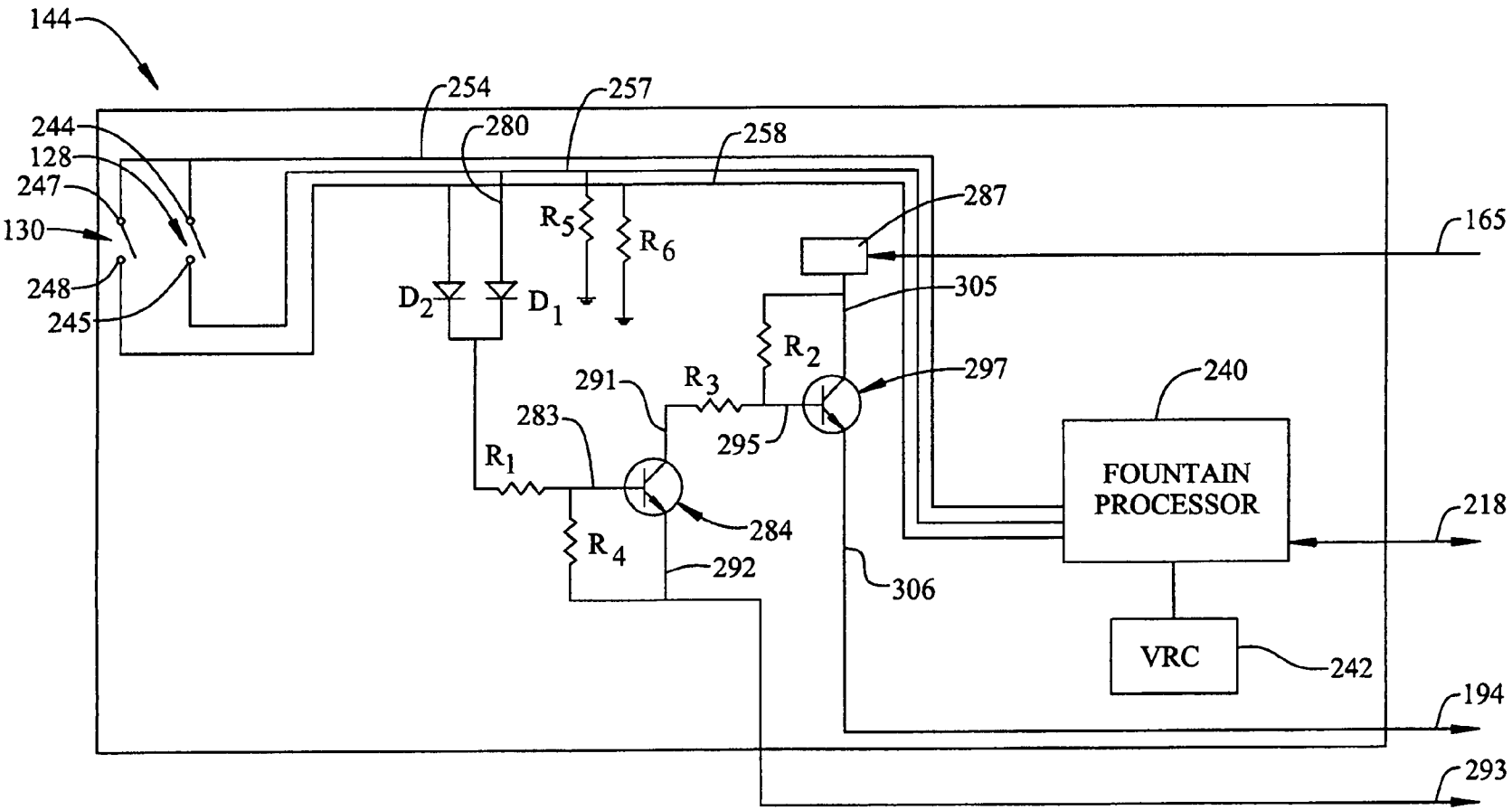
FIG. 4 is a schematic view of a second portion of the dispenser control system.

As best shown in FIGS. 3 and 4, control system 140 includes first and second control circuits 142 and 144. First or main control circuit 142 controls operation of main dispensing components as will be discussed more fully below, while second or fountain control circuit 144 provides signals to main control circuit 142 enabling activation of the main dispensing components in a manner that will also be discussed more fully below. With particular reference to FIG. 3, main control circuit 142 is operatively connected to a first motor or drive unit 157 which, in accordance with the present invention, constitutes an activation solenoid of a water valve. Main control circuit 142 is also operatively connected to a second motor or drive unit shown 159 which takes the form of an ice dispensing auger. Main control circuit 142 also contains a crushed ice select line 161 that provides input to auger 159 causing ice to be directed through a crusher depending upon user preferences. In any event, water valve 157 and auger 159 are coupled to a power supply 163 which provides line voltage, preferably approximately 120 volts, from power system 70. Power supply 163 also feeds a power supply box 164, which provides low voltage (preferably approximately 12 volts) to main control circuit 142 and, through line 165, to fountain control circuit 144.

In accordance with the invention, main control circuit 142 includes a plurality of control switches 169-171 which control operation of water valve 157, auger 159 and crushed ice select line 161 respectively. Each control switch 169-171 includes a corresponding relay portion 178-180 that selectively engages a contact portion 184-186 coupling water valve 157, auger 159 and crushed ice select line 161 to power supply 163. In addition, each relay portion 178-180 includes a corresponding diode circuit 189-191 to prevent feedback voltage from a corresponding one of control switches 169-171. As will be discussed more fully below, each relay portion 178-180 is activated by power supplied from a relay control line 194 through a respective drive switch 197-199. More specifically, drive switches 197-199 include corresponding control input terminals 204-206, as well as respective first and second main terminals 207, 208, 210, 211 and 213, 214. Input terminals 204-206 are activated by signals provided by a main processing unit 216. A signal from main processor 216 at one or more of input terminals 204-206 allows current to pass from relay control line 194 to a respective control switches 169-171. The particular drive switch 197-199 activated depends upon signals received based on the pressing of a key 116-118 from keypad 110 through a signal line 218 in a manner that will be discussed more fully below. Main processor 216 receives power from power supply box 164 which is coupled to power system 70 and includes a voltage regulator circuit 220 that outputs very low voltage, preferably approximately 5 volts.

With reference to FIG. 4, fountain control circuit 144 includes a second or fountain processor 240 coupled to a voltage regulator circuit 242 that supplies approximately 5 volts and, as described above, is coupled to power supply box 164 through line 165. Processor 240 is also coupled to dispensing switches 128 and 130. More specifically, each dispensing switch 128, 130 preferably takes the form of a membrane switch having corresponding first and second terminals 244, 245 and 247, 248, with first terminals 244, 247 receiving power from processor 240 through a supply line 254 and second terminals 245, 248 providing a switch status signal to processor 240 through a corresponding return line 257, 258. Preferably, processor 240 pulses supply line 254 until sensing that a dispensing switch 128, 130 has been closed through a corresponding return line 257, 258. Once processor 240 senses that one of dispensing switches 128, 130 has been closed, power is provided to supply line 254 continuously until switch 128 or 130 is released. In any event, from the above description, it should be understood that main control circuit 142 and fountain control circuit 144 are linked by four lines, i.e., lines 165, 194, 218 and a common or ground line 293.

In addition to providing an input signal to processor 240, switches 128 and 130 enable current to pass along relay control line 194 to first control circuit 142. As each switch 128, 130 provides current to relay control line 194 in a similar manner, a detailed description will be made with respect to the closing of dispensing switch 128 with an understanding that the closing of dispensing switch 130 operates in a similar manner. Once switch 128 is closed, a signal is sent through return line 257 into a branch circuit 280, through a diode D1 and resistor R1, and into an input terminal 283 of a first switching unit 284. Once power is provided at input terminal 283, switching unit 284 enables low voltage power, preferably approximately 12 volts, to pass from power supply box 164 through a resistor R2, resistor R3, and first and second main terminals 291, 292 of switching unit 284 before passing to ground line 293. After passing through resistor R2, current is also received at a second input terminal 295 of a second switching unit 297. At this point, low voltage from power supply box 164 can pass through first and second main terminals 305, 306 of second switching unit 297 into relay control line 194 and pass to first control circuit 142. In this manner, switching unit 284 and switching unit 297, as well as resistors R1-R4, form an overall switching device of second control circuit 144.

Once relay control line 194 is powered, current is received at first main terminals 207, 210 and 213 of drive switches 197-199 respectively. Having received a signal from a switch 116-118 on keypad 110, main processor 216 selectively activates one or more of input terminals 204, 205 and 206 of drive switches 197-199 in order to allow current to pass to one or more of control switches 169-171. Thus, for example, if a consumer simply wants to dispense water from dispensing unit 14, activating switch 128 and key 116 sends power along relay control line 194, while main processor 216 provides a signal to input terminal 204, thereby allowing control switch 169 to activate water valve 157, releasing water from dispensing unit 14. In a similar manner, the operation of control switch 170, with or without control switch 171, can be controlled.

At this point, it should be understood that the present invention provides a control system that ensures that single or multiple electronic component failures will not result in unintended dispensing of a water product from dispensing unit 14. That is, by ensuring that current passes through dispensing switches 128 and/or 130, and by providing multiple levels of redundancy, such as switching units 284, 297 and drive switches 197-199, dispensing unit 14 will not release a water product without being activated by a consumer. In this way, second control circuit 144 actually regulates the ability of main processor 216 to operate drive units 157 and 159. Therefore, a short in main processor 216, which could potentially provide a signal to one or more of input terminals 204-206, would still not enable an unintended dispensing operation to occur. Similarly, a short in fountain processor 240 would not enable power to flow through relay control line 194. Moreover, the use of three different voltage levels provides a further control degree against an unintentional dispensing operation, while also enabling membrane switches to be readily used in dispensing unit 14 given the minimal voltage levels maintained at dispensing unit 14 at all times.

Although described with reference to a preferred embodiment of the invention, it should be readily understood that various changes and/or modifications can be made to the invention without departing from the spirit thereof. For instance, the number and types of switching units, drive units, and the like can be varied without departing from the spirit of the present invention. In addition, the control system could also be employed to dispense other substances, such as juice and other water-based products. In general, the invention is only intended to be limited by the scope of the following claims.

We claim:

1. A refrigerator comprising:

a cabinet within which is defined a refrigeration compartment;

a door pivotally mounted to the cabinet for selectively closing the refrigeration compartment;

a dispensing unit for dispensing a water product, said dispensing unit including a dispensing switch selectively operated by a consumer;

a drive unit which, when activated, causes the water product to be delivered to the dispensing unit;

a first control circuit for activating the drive unit, said first control circuit including a control switch electrically connected between a first voltage source, having a first voltage level, and the drive unit;

a second control circuit linked to the first control circuit, said second control circuit including a switching device electrically coupled between a second voltage source, having a second voltage level which is different than the first voltage level, and the first control circuit; and at least one processor supplying power to the dispensing switch at a third voltage level which is different than the first voltage level, wherein operation of the dispensing switch by a consumer, activates the switching device and enables actuation of the control switch to couple the drive unit to the first voltage source causing the water product to be delivered to the dispensing unit.

2. The refrigerator according to claim 1, wherein the water product is selected from the group of ice and water, said dispensing unit having a plurality of selector members that enable selection of dispensing ice and water.

3. The refrigerator according to claim 2, wherein the first control circuit includes a plurality of control switches selectively activated to deliver water, crushed ice and cubed ice to the dispensing unit.

4. The refrigerator according to claim 2, wherein the first control circuit further includes a drive switch coupled between the switching device and the control switch, said drive switch receiving a signal based on a selection made through one of the plurality of selector members to enable activation of the control switch.

5. The refrigerator according to claim 4, further comprising: another processor linked to the first control circuit and the plurality of selector switches.

6. The refrigerator according to claim 5, wherein the another processor signals the drive switch to enable activation of the control switch.

7. The refrigerator according to claim 1, wherein the switching device is powered by at the third voltage level through the dispensing switch.

8. The refrigerator according to claim 7, wherein the switching device includes first and second switching units, wherein activation of the first switching unit at the third voltage level activates the second switching unit at the second voltage level.

9. The refrigerator according to claim 1, wherein the third voltage level is different from the second voltage level.

10. The refrigerator according to claim 8, wherein the first voltage level is approximately 120 volts AC, the second voltage level is approximately 12 volts DC and the third voltage level is approximately 5 volts DC.

11. A refrigerator comprising:

a cabinet;

a liner arranged within the cabinet, said liner defining at least one refrigerated compartment;

a door pivotally mounted to the cabinet for selectively closing the at least one refrigerated compartment;

a dispenser provided in the door for selectively releasing a water product;

means for actuating the dispenser, said actuating means having first and second terminals;

a drive unit for delivering the water product to the dispenser;

a processor having an input terminal coupled to the second terminal of the actuating means;

a switching unit having an input terminal coupled to the second terminal of the actuating means and first and second main current electrodes;

a power system having a supply terminal and a ground, said supply terminal being connected to the first terminal of the actuating means and the first main current electrode; and means for activating the drive unit, said drive unit activating means being coupled between the second main electrode and ground wherein, activation of the actuating means initiates the drive unit activating means, powering the drive unit to release the water product from the dispenser.

12. The refrigerator according to claim 11, wherein the power system includes first, second and third power supplies, said first power supply being a very low voltage power supply, said second power supply being a low voltage power supply and said third power supply providing line voltage.

13. The refrigerator according to claim 12, wherein the low voltage power supply produces approximately 12 volts DC and the very low voltage power supply produces approximately 5 volts DC.

14. The refrigerator according to claim 13, wherein the first and second terminals of the actuation means are coupled to the processor and said first terminal of the actuating means being coupled to the very low voltage power supply.

15. The refrigerator according to claim 14, wherein the actuating means is constituted by a membrane switch.

16. The refrigerator according to claim 13, wherein the second power supply is coupled to the first main electrode.

17. The refrigerator according to claim 16, further comprising: another switching device having an input terminal coupled to the second terminal of the actuating means and first and second main current terminals, said first main current terminal being connected to the input terminal of the switching device and said second main current electrode being connected to ground.

18. The refrigerator according to claim 11, wherein the drive unit is constituted by a water valve.

19. The refrigerator according to claim 11, wherein the drive unit is constituted by an ice auger.

* * * * *